US007247034B2

(12) United States Patent
Matsuzaki et al.

(10) Patent No.: US 7,247,034 B2
(45) Date of Patent: Jul. 24, 2007

(54) ELECTRONIC DEVICE AND DISPLAY DEVICE WITH PRINTED WIRING BOARD HAVING CONNECTOR AND LOCKING MEMBER

(75) Inventors: Yukio Matsuzaki, Mobara (JP); Kazumi Akiba, Ooamishirasato (JP); Masaki Tsubokura, Mobara (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 0 days.

(21) Appl. No.: 11/476,749

(22) Filed: Jun. 29, 2006

(65) Prior Publication Data

US 2007/0004250 A1 Jan. 4, 2007

(30) Foreign Application Priority Data

Jun. 29, 2005 (JP) ..... 2005-189244

(51) Int. Cl.
*H01R 12/00* (2006.01)

(52) U.S. Cl. ..... 439/79; 439/67; 439/492; 174/254

(58) Field of Classification Search ..... 439/79, 439/492, 495, 67; 174/254
See application file for complete search history.

(56) References Cited

U.S. PATENT DOCUMENTS

| | | | | |
|---|---|---|---|---|
| 4,639,062 | A * | 1/1987 | Taniguchi et al. | 439/586 |
| 5,385,478 | A * | 1/1995 | Niekawa | 439/67 |
| 6,333,467 | B1 * | 12/2001 | Matsuo | 174/254 |
| 2001/0034156 | A1 * | 10/2001 | Yamane | 439/492 |

FOREIGN PATENT DOCUMENTS

| | | | |
|---|---|---|---|
| JP | 7-296941 | | 11/1995 |
| JP | 09312470 | A1 * | 12/1997 |
| JP | 001109258 | A2 * | 6/2001 |

* cited by examiner

*Primary Examiner*—Michael C. Zarroli
(74) *Attorney, Agent, or Firm*—Antonelli, Terry, Stout & Kraus, LLP.

(57) ABSTRACT

The present invention prevents a connection defect of a connector. In an electronic device which includes a film-like wiring board and a printed wiring board on which a connector is mounted, the film-like wiring board includes a projecting portion which projects to a side opposite to the printed wiring board at a position where the film-like wiring board is exposed from the connector into which the film-like wiring board is inserted.

11 Claims, 5 Drawing Sheets

ELECTRONIC DEVICE AND DISPLAY DEVICE WITH PRINTED WIRING BOARD HAVING CONNECTOR AND LOCKING MEMBER

BACKGROUND OF THE INVENTION

1. Field of the Invention

The present invention relates to an electronic device and a display device, and more particularly to a technique which is effectively applicable to a device which connects lines of a film-like printed wiring board and lines of a printed wiring board using an open/close type connector.

2. Description of the Related Art

Conventionally, in an electronic device such as a notebook-type PC (Personal Computer), a PDA (Personal Digital Assistant), a digital still camera or a mobile phone terminal, along with the miniaturization of a body, there has been a demand that a plurality of electronic parts and a printed wiring board must be housed in the inside of a small housing.

As a method for housing the plurality of electronic parts and the printed wiring board in the inside of the small housing, for example, a method which miniaturizes the respective electronic parts and the printed wiring board is known. However, in view of the sophistication of functions of the electronic device and the reliability of operations of the respective electronic parts and the printed wiring board, the miniaturization of the parts and the printed wiring board is becoming more difficult recently.

Accordingly, recently, for example, there has been adopted a method in which the printed wring board is divided into a plurality of printed wiring boards and the respective printed wiring boards are connected with each other using film-like printed wiring boards which are referred to as flexible printed wiring boards. The flexible printed wiring board is a board which forms wiring or lines on a surface of a film-like insulating substrate and is bendable. Accordingly, by connecting the plurality of printed wiring boards using the film-like wiring board and bending the flexible printed wiring board so as to arrange the respective printed wiring boards in an overlapped manner, it is possible to efficiently house the respective electronic parts and the printed wiring board in the inside of the small housing.

Further, the electronic device includes, for example, a liquid crystal display device such as a liquid crystal display for a liquid crystal television receiver set or the PC. In the liquid crystal display device, for example, the film-like wiring board is used at the time of electrically connecting lines on a printed wiring board or a printed circuit board which is arranged on an outer peripheral portion of a liquid crystal display panel and lines of a printed circuit board having a circuit such as timing controller which is mounted on a back surface of a backlight unit which is mounted on a back side of the liquid crystal display panel.

In electrically connecting the lines of the film-like wiring board and the lines of the printed wiring board, for example, the connection may be performed using a bonding material or the like. In this case, for example, heating and pressurizing become necessary for optical alignment or bonding. Further, when a defect such as the misalignment or the like is generated at the time of performing the connection, it is necessary to peel off the film-like wiring board once and, thereafter, to perform the connecting operation again. Particularly, when the film-like wiring board is a cable which serves to electrically connecting the plurality of the lines of the printed wiring boards, the connecting operation is performed in an assembling step of the electronic device and hence, when the connecting operation is performed using the bonding material or the like, an operational efficiency or the operability is worsened. Accordingly, in connecting the lines of the plurality of printed wiring boards using the film-like wiring board (cable), an easily detachable connector is used in general.

The connector is, for example, fixed to the printed wiring board, while leads which are electrically connected with the lines of the printed wiring board are provided to an inserting portion of the film-like wiring board. Further, the film-like wiring board is inserted into the connector so as to bring the lines of the film-like wiring board and the leads of the connector into a contact and fixed state thus electrically connecting the lines of the film-like wiring board and the lines of the printed wiring board.

However, the film-like wiring board is, as mentioned previously, formed of the easily bendable wiring board. Accordingly, in inserting the film-like wiring board into the connector, the film-like wiring board is bent thus exhibiting the poor operability. Accordingly, as a method for improving the operability at the time of inserting the film-like wiring board into the connector, there has been proposed a method which uses an inserting jig or the like (see JP-A-7-296941, for example.

SUMMARY OF THE INVENTION

The connector usually includes means which prevents the removal of the inserted film-like wiring board. As means which prevents the removal of the film-like wiring board, an open/close type locking member is named, for example.

The connector which includes the open/close type locking member is, for example, as shown in FIG. 9, configured such that a locking member 303 is mounted on a support member 302 which supports a lead 301 which is electrically connected with a line 202 of the printed wiring board 202 and the film-like wiring board 1 in a state that the locking member 303 is rotatable about a predetermined shaft. Here, the locking member 303 is provided on a back side of a contact surface between the line 102 of the film-like wiring board 1 and the lead 301. Then, after inserting the film-like wiring board 1 in a state that the locking member 303 is directed as indicated by a dotted line in FIG. 9 (an open state), for example, the locking member 303 is rotated to a state in which the locking member 303 is directed as indicated by a solid line (a closed state), a fixing portion 303*a* of the locking member 303 is brought into contact with the film-like wiring board 1 and hence, the lines 102 of the film-like wiring board and the lead 301 are brought into contact with each other and are fixed to each other.

Further, in removing the film-like wiring board 1, by bringing the locking member 303 into the open state from the locking state, the fixing portion 303*a* of the locking member 303 is separated from the film-like wiring board 1 and can be easily removed.

However, in case of the connector which includes the open/close type locking member, after bringing the lines of the film-like wiring board and the lead into a contact and fixed state by the locking member, there may be a case that the locking member 303 is shifted from the locking state to the open state due to an unintended factor such as other electronic parts, other printed wiring board or a finger of an operator who performs an assembling operation comes into contact with the locking member. When the locking member assumes the open state, the contact between the lines of the film-like wiring board and the lead becomes incomplete thus giving rise to an operational defect. Here, when the operator is aware of that the locking member is in an open state in the course of the assembling operation, it is possible to prevent the operational defect by bringing the locking member into a locking state. However, when the operator continues the assembling operation without being aware of that the locking member is in an open state and, for example, a periphery of the printed wiring board is covered with a cover member or the like, in performing an operation test of an assembled electronic device, an operational defect attributed to a contact defect arises. In this case, it is necessary to bring the locking member in the open state into the locking state by disassembling the assembled electronic device. Accordingly, there has been a drawback that the efficiency of the assembling operation of the electronic device is worsened.

Further, there has been also a drawback that when the locking member is in a half-locking state, even when the electrical connection is normal in an inspection state, the locking is released due to the vibrations and impacts during the transportation of an electronic device to a client, and the electronic device turns out to be defective when the client uses the electronic part.

Accordingly, it is an object of the present invention to provide, in an electronic device which electrically connects lines of a film-like wiring board and lines of a printed wiring board by a connector which includes an open/close type locking member, a technique which can prevent a phenomenon that the locking member which once assumes a locking state is shifted to an open state thus generating a connection failure between the lines of the film-like wiring board and leads of the connector.

It is another object of the present invention to provide a technique which can prevent the locking member from being brought into the open state from the locking state due to an unexpected cause at the time of assembling the electronic device.

It is still another object of the present invention to provide, in a display device which includes a display panel such as a liquid crystal display panel among electronic devices, a technique which can prevent the locking member from being brought into the open state from the locking state due to an unexpected cause.

The above-mentioned and other objects and novel features of the present invention will become apparent from the description of this specification and attached drawings.

To explain specific constitutional examples of an electronic device and a display device of the present invention, they are as follows.

(1) The present invention is directed to an electronic device which includes a film-like wiring board and a printed wiring board to which a connector is provided, wherein the film-like wiring board includes a projecting portion on a side opposite to the printed wiring board at a position where the film-like wiring board is exposed from the connector in a state that the film-like wiring board is inserted into the connector.

(2) The electronic device is, in the above-mentioned means (1), characterized in that the connector includes a locking member and the projecting portion is positioned on a side remote from the connector with respect to the locking member.

(3) The electronic device is, in the above-mentioned means (1) or (2), characterized in that the projecting portion functions as a protective member.

(4) The electronic device is, in any one of the above-mentioned means (1) to (3), characterized in that the projecting portion projects from a position at which the locking member is locked.

(5) An electronic device which includes a film-like wiring board which forms first lines on a surface of a film-like insulating substrate, a printed wiring board which forms second lines which are electrically connected with the first lines thereon, and a connector which is formed on the printed wiring board and into which the film-like wiring board is inserted, and the connector includes leads which are electrically connected with the second lines, a support member which supports the leads and the film-like wiring board and a locking member which is arranged on a back side of the film-like wiring board opposite to a contact surface of the film-like wiring board with the first lines and the leads and is made to rotate about a predetermined shaft so as to bring the first lines and the leads into a contact and fixed state or to release the contact and fixed state, wherein the film-like wiring board includes a protective member which prevents the locking member from being shifted from the state in which the locking member brings the first lines and the leads into the contact and fixed state to a state in which the contact and fixed state is released on a surface side of a film-like insulating substrate which is brought into contact with the locking member.

(6) The electronic device is, in the above-mentioned means (5), characterized in that the film-like wiring board is arranged on a surface side of the film-like insulating substrate which is brought into contact with the locking member, a reinforcing member is arranged on a region which is inserted into the connector and an outside of the region, and the protective member is arranged on the reinforcing member.

(7) The electronic device is, in the above-mentioned means (5), characterized in that the protective member includes a reinforcing portion which extends in the direction toward the region which is inserted into the connector on an interface side thereof with the film-like insulating substrate.

(8) The electronic device is, in any one of the above-mentioned means (5) to (7), characterized in that a distance between a surface of the film-like insulating substrate and a point of the protective member remotest from a surface of the insulating substrate is equal to or more than a distance between the surface of the insulating substrate and a point of the locking member remotest from the surface of the insulating substrate in a state that the first lines and the leads are brought into a contact and fixed state.

(9) A display device which includes a display panel, a film-like wiring board which forms first lines on a surface of a film-like insulating substrate, a printed wiring board which forms second lines which are electrically connected with the first lines thereon, and a connector which is formed on the printed wiring board and into which the film-like wiring board is inserted, and the connector includes leads which are electrically connected with the second lines, a support member which supports the leads and the film-like wiring board and a locking member which is arranged on a back side of the film-like wiring board opposite to a contact surface of the film-like wiring board with the first lines and the leads and is made to rotate about a predetermined shaft so as to bring the first lines and the leads into a contact and fixed state or to release the contact and fixed state, wherein the film-like wiring board includes a protective member which prevents the locking member from being shifted from the state in which the locking member brings the first lines and the leads into the contact and fixed state to a state in which the contact and fixed state is released, on a surface side of a film-like insulating substrate which is brought into contact with the locking member.

(10) The display device is, in the above-mentioned means (9), characterized in that the film-like wiring board is arranged on a surface side of the film-like insulating substrate which is brought into contact with the locking member, a reinforcing member is arranged on a region which is inserted into the connector and an outside of the region, and the protective member is arranged on the reinforcing member.

(11) The display device is, in the above-mentioned means (9), characterized in that the protective member includes a reinforcing portion which extends in the direction toward the region which is inserted into the connector on an interface side thereof with the film-like insulating substrate.

(12) The display device is, in any one of the above-mentioned means (9) to (11), characterized in that a distance between a surface of the film-like insulating substrate and a point of the protective member remotest from a surface of the insulating substrate is equal to or more than a distance between the surface of the insulating substrate and a point of the locking member remotest from the surface of the insulating substrate in a state that the first lines and the leads are brought into a contact and fixed state.

In the electronic device of the present invention, as in the case of the means (1), the film-like wiring board includes the projecting portion. Here, the projecting portion is, as in the case of the means (2), positioned on a side remoter from the connector with respect to the locking member of the connector. Here, the projecting portion functions as the protective member which protects the locking member of the connector as in the case of the means (3), for example. Accordingly, the projecting portion may preferably project from the position when the locking member is locked as shown in the means (4).

Further, the specific constitutional example of the electronic device having the means (1) to (4) may be exemplified by the means (5), for example. As in the case of the means (5), by providing the protective member which protects the locking member in a state that the lines of the film-like wiring board and the lines of the printed wiring board are brought into contact with each other and are fixed to each other (in a locking state), for example, it is possible to prevent a phenomenon that the locking member is shifted from the locking state to a state in which other electronic part, the printed wiring board or a finger of an operator which performs an assembling operation comes into contact with the locking member and the locking is released (an open state). Accordingly, it is possible to prevent the locking member from being shifted from the locking state to the open state due to an unintended cause. As a result, in performing an operation inspection of the assembled electronic device, it is possible to reduce operational defects attributed to the fact that the locking member assumes the open state thus enhancing the efficiency of the assembling operation of the electronic device.

Further, when the protective member is provided to the film-like wiring board, it is possible to insert the film-like wiring board into the connector while watching the protective member. Accordingly, due to the positional relationship between the protective member and the connector, for example, it is possible to confirm an insertion quantity of the film-like wiring board or whether the film-like wiring board is inserted obliquely or not and hence, the operability is enhanced.

Further, in general, the film-like wiring board may be provided with the reinforcing member in the inserting portion thereof into the connector or in the vicinity of the inserting portion for preventing the bending of the film-like wiring board at the time of insertion. In this case, the protective member is provided over the reinforcing member as in the case of the means (6). Here, the protective member may be formed of the same material as the reinforcing member or may be made of a material different from a material of the reinforcing member.

Further, when the protective member is provided over the reinforcing member as in the case of the means (6), depending on an adhesive strength between the protective member and the reinforcing member, when other electronic part, other printed wiring board or a finger of an operator who performs an assembling operation comes into contact with the protective member, the protective member may be peeled off. Accordingly, for example, as in the case of the means (7), it is preferable to provide the reinforcing portion in the vicinity of the interface between the protective member and the film-like insulating substrate. In the means (7), since the protective member and the reinforcing member of the means (6) are constituted as an integral body and hence, there arises no problem such as peeling-off of the protective member.

Further, the protective member is a member which serves to prevent the locking member in the locking state from being shifted to the open state due to an unexpected cause and hence, it is preferable to set a height of the protective member greater than a height of the locking member in the locking state as in the case of the means (8).

Further, the above-mentioned means (5) to (8) are, for example, applicable to any electric devices such as a notebook type PC or PDA, a digital still camera, a mobile phone terminal or the like provided that the electronic device electrically connects the lines of the film-like wiring board and the printed wiring board using the open/close type connector. It is particularly preferable to apply the above-mentioned means (5) to (8) to the display device which includes a display panel of the means (9) to (12).

DESCRIPTION OF THE PREFERRED EMBODIMENT

Hereinafter, embodiments of the present invention are explained in detail in conjunction with drawings.

Here, in all drawings for explaining the embodiments, parts having identical functions are given same symbols and their repeated explanation is omitted.

To a film-like wiring board which is inserted into a connecter which includes an open/close type locking member mounted on a printed wiring board, a protective member which protects the locking member in a locking state is provided, and the protective member prevents other electronic part, the printed wiring board or a finger of an operator which performs an assembling operation from coming into contact with the locking member and being shifted to an open state.

Figure 1:
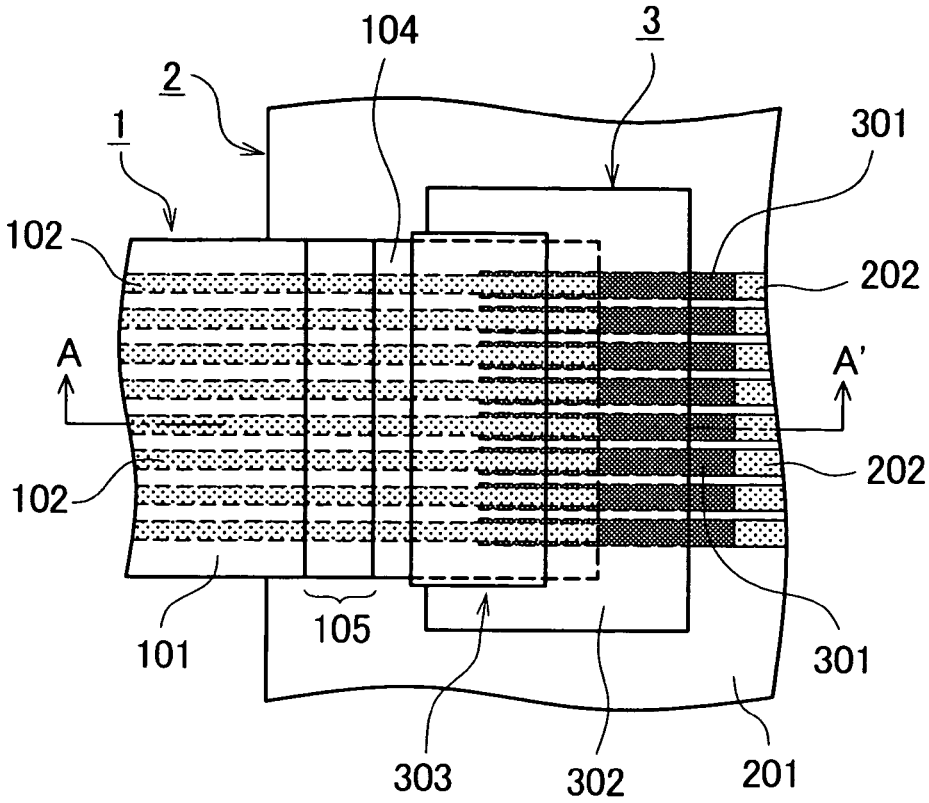
FIG. 1 is a schematic view for explaining the summary of an electronic device of the present invention and also is a plan view showing the schematic constitution of a connecting portion of a film-like wiring board and a printed wiring board of the electronic device.
Figure 2:
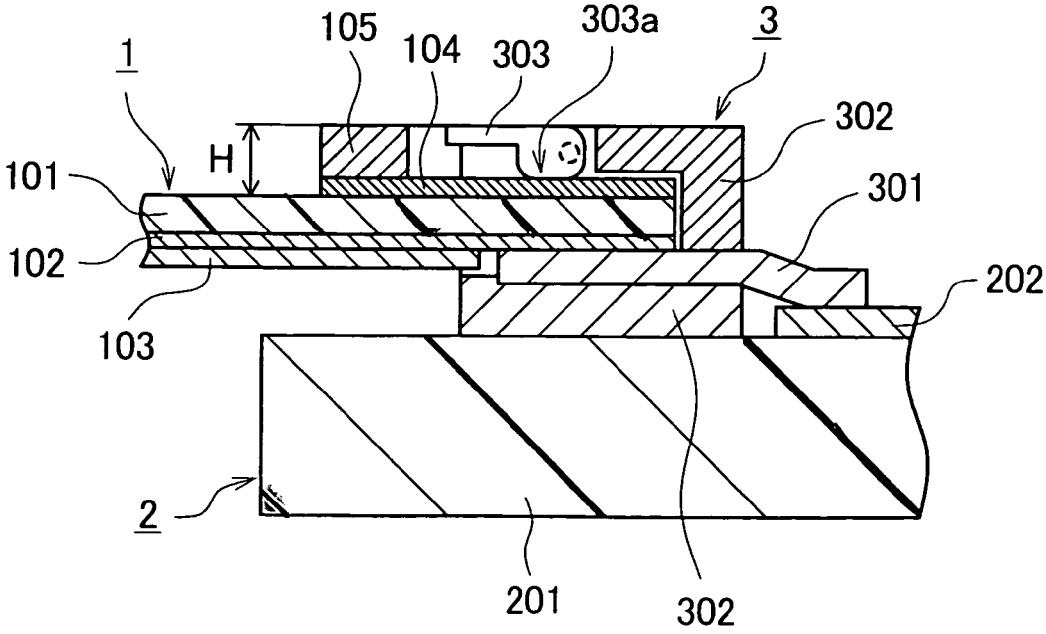
FIG. 2 is a schematic view for explaining the summary of the electronic device of the present invention and also is a cross-sectional view taken along a line A–A' in FIG. 1.
Figure 3:
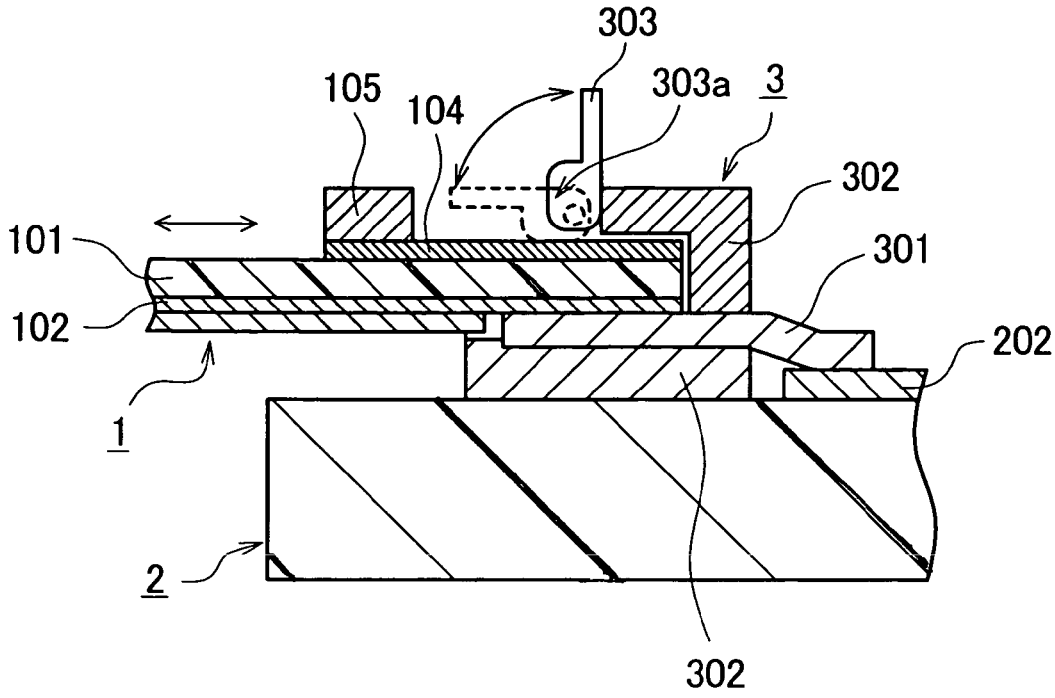
FIG. 3 is a schematic view for explaining the summary of the electronic device of the present invention and also is a cross-sectional view for explaining a mounting method of the film-like wiring board.
Figure 4:
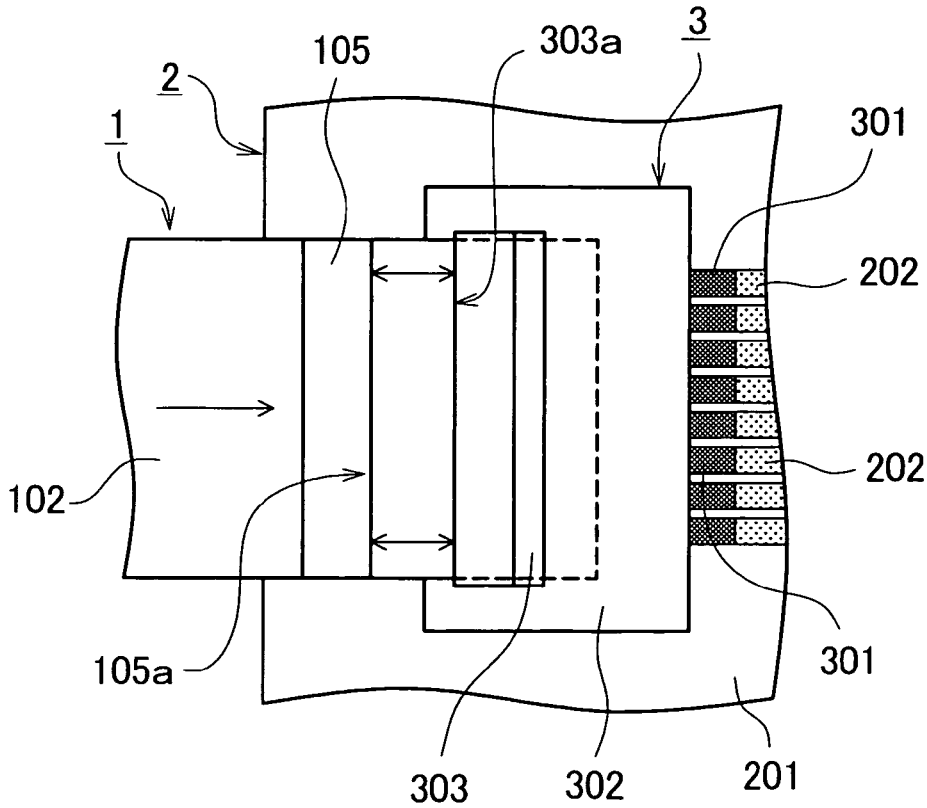
FIG. 4 is a schematic view for explaining the summary of the electronic device of the present invention and also is a plan view for explaining one example of other advantages.

FIG. 1 to FIG. 4 are schematic views for explaining the summery of an electronic device of the present invention, wherein FIG. 1 is a plan view showing the schematic constitution of a connecting portion of a film-like wiring board and a printed wiring board of the electronic device, FIG. 2 is a cross-sectional view taken along a line A–A' in FIG. 1, FIG. 3 is a cross-sectional view for explaining a mounting method of the film-like wiring board, and FIG. 4 is a plan view for explaining one example of other advantages.

In FIG. 1 to FIG. 4, numeral 1 indicates a film-like wiring board, numeral 101 indicates a film-like insulating substrate, numeral 102 indicates lines (first lines), numeral 103 indicates a line protective film, numeral 104 indicates a reinforcing member, numeral 105 indicates a protective member, numeral 2 indicates a printed wiring board, numeral 201 indicates an insulating substrate, numeral 202 indicates lines (second lines), numeral 3 indicates a connector, numeral 301 indicates leads, numeral 302 indicates a support member, numeral 303 indicates a locking member, and numeral 303*a* indicates a fixing portion.

The electronic device of the present invention includes, for example, as shown in FIG. 1 and FIG. 2, the film-like wiring board 1 which forms the first lines 102 on a surface of the film-like insulating substrate 101, the printed wiring board 2 which forms the second lines 202 which are electrically connected with the first lines 102 on a surface of the insulating substrate 201, and the connector 3 which is mounted on the printed wiring board 2 and into which the film-like wiring board 1 is inserted.

Further, the film-like wiring board 1 is, for example, as shown in FIG. 2, provided with the reinforcing member 104 on a portion thereof which is inserted into the connector 3 and the outside the portion for preventing warping or bending of the film-like wiring board 1. Further, in the reinforcing member 104 in a region outside the reinforcing member 104 which is inserted into the connector 3, the protective member 105 is provided. Further, the film-like wiring board 1 may be, for example, formed of an easily bendable wiring board which is referred to as a flexible printed wiring board.

Further, the printed wiring board may be, for example, a wiring board on which lines of a control circuit which control an operation of the electronic device or the like are mounted. Here, the printed wiring board may, for example, include one or more inner wiring layers in the inside of the insulating substrate.

Further, the connector 3 includes the leads 301 which are electrically connected with the second lines 202, the support member 302 which supports the leads 301 and the film-like wiring board 1, and the locking member 303 which is arranged on a back side of the film-like wiring board 1 opposite to a contact surface of the film-like wiring board 1 with the first lines 102 and the leads 301 and is made to rotate about a predetermined shaft so as to bring the first lines 102 and the leads 301 into a contact and fixed state or to release the contact and fixed state. Here, with respect to the locking member 303, a state shown in FIG. 2 is a state in which the first lines 102 and the leads 301 are brought into the contact and fixed state (locking state), wherein by clamping the film-like wiring board 1 by the fixing portion 303*a* of the locking member 303 and the leads 301, it is possible to ensure the contact between the first lines 102 and the leads 301 and, at the same time, it is possible to fix the film-like wiring board 1 to prevent the removal of the film-like wiring board 1. Further, when the locking member 303 is rotated about the rotary shaft, for example, as shown in FIG. 3, the fixing portion 303*a* is separated from the film-like wiring board 1 (reinforcing member 104). That is, in inserting and fixing the film-like wiring board 1 in the connector 3, the locking member 303 is set in a state shown by a solid line in FIG. 3 (open state), the film-like wiring board 1 is inserted and, thereafter, the locking member 303 is brought into a locking state shown in FIG. 2 thus fixing the film-like wiring board 1.

Further, the protective member 105 which is mounted on the film-like wiring board 1 is a member which prevents the locking member 303 from shifting from the locking state to the open state, that is, from the state shown in FIG. 2 in which the first lines 102 and the leads 301 are brought into the contact and fixed state to the state shown in FIG. 3 with a solid line. Here, it is preferable that, for example, as shown in FIG. 2, a height of the film-like wiring board 1 from a surface of the insulating substrate 101, that is, a distance H to a remotest point becomes equal to a height of the locking member 303 in the locking state from the surface of the insulating substrate 101. Due to such a constitution, for example, it is possible to prevent other electronic part, other printed wiring board or a finger of an operator who performs an assembling operation from coming into contact with the locking member 303 in the locking state thus shifting the locking state to the open state.

Here, it is sufficient for the protective member 105 that the protective member 105 can prevent other electronic part, other printed wiring board or the finger of the operator who performs the assembling operation from coming into contact with the locking member 303 in the locking state thus shifting the locking state to the open state and hence, the height H of the protective member 105 from the surface of the insulating substrate 101 of the film-like wiring board 1 may be set substantially equal to the height of the locking member 303 in the locking state from the surface of the insulating substrate 101 or higher than the height of the locking member 303 in the locking state from the surface of the insulating substrate 101.

Further, in the electronic device of the present invention, when the film-like wiring board 1 is inserted into the connector 3, for example, as shown in FIG. 4, on the insulating substrate 101 of the film-like wiring board 1, the protective member 105 having an end surface 105*a* in the direction perpendicular to the inserting direction appears. Accordingly, when the film-like wiring board 1 is inserted into the connector 3, for example, as shown in FIG. 4, it is possible to confirm an insertion quantity of the film-like wiring board 1 or whether the film-like wiring board 1 is inserted obliquely or not based on a distance between the fixing portion 303*a* of the locking member 303 and an end surface 105*a* of the protective member 105. Accordingly, it is possible to bring the locking member 303 into the locking state from the open state in a state that the locking member 303 is correctly inserted in the connector 3 and hence, the connection defect between the lines 102 of the film-like wiring board 1 and the leads 301 attributed to an insertion defect can be reduced whereby the operability is enhanced.

Further, provided that the electronic device of the present invention includes the film-like wiring board 1, the printed wiring board 2 and the connector 3 having the constitution shown in FIG. 1 to FIG. 3, the other remaining constitution of the electronic device of the present invention may adopt any constitution. For example, the constitution shown in FIG. 1 to FIG. 3 may be applicable to various electronic devices including a notebook-type PC, a digital still camera, a mobile phone terminal, a liquid crystal display device and the like.

As has been explained above, according to the electronic device of the present invention, by providing the protective member 105 to the film-like wiring board 1, for example, the protective member prevents other electronic part, the printed wiring board or a finger of an operator which performs an assembling operation from coming into contact with the locking member 303 in the locking state and being shifted to an open state. Accordingly, for example, even when the operator assembles the electronic device without being aware of the fact that the locking member 303 is in the open state in the midst of the assembling, it is possible to prevent the connection defect of the lines 102 of the film-like wiring board 1 and the leads 301 of the connector 3 attributed to the fact that the locking member 303 is in the open state. As a result, in performing an operation inspection of the assembled electronic device, it is possible to prevent the operation defect attributed to the fact that the locking member 303 is in an open state.

Further, by providing the protective member 105, it is possible to prevent the locking member 303 from being shifted to the open state due to an unexpected cause and hence, a defect attributed to the fact that the locking member 303 is in the open state can be reduced and hence, an operation to correct the locking member 303 into the locking state from the open state may be reduced. Accordingly, the operability of the assembling operation of the electronic device can be enhanced.

Further, due to the provision of the protective member 105 to the film-like wiring board 1, by watching the positional relationship between the protective member 105 and a periphery thereof at the time of inserting the film-like wiring board 1 into the connector 3, it is possible to confirm whether the film-like wiring board 1 is correctly inserted or not. Accordingly, it is possible to reduce the connection defect between the lines 102 of the film-like wiring board 1 and the leads 301 attributed to the insufficient insertion of the film-like wiring board 1 whereby the operability is enhanced.

Further, in the above-mentioned assembling step of the electronic device, when other electronic parts and the like are brought into contact with the locking member 303, for example, the locking member 303 does not assume the complete open state shown in FIG. 3 but also may assume an incomplete (half) locking state. In such a half locking state, even when the electrical connection is normal in an inspection stage, due to vibrations or an impact during the transportation of the electronic device to a client, there may be a case that the locking is released and the electrical connection becomes defective when the client uses the electronic device. Accordingly, by providing the protective member 105 to the film-like wiring board 1 as in the case of the present invention, it is also possible to prevent the locking from assuming the half locking state.

Figure 5:
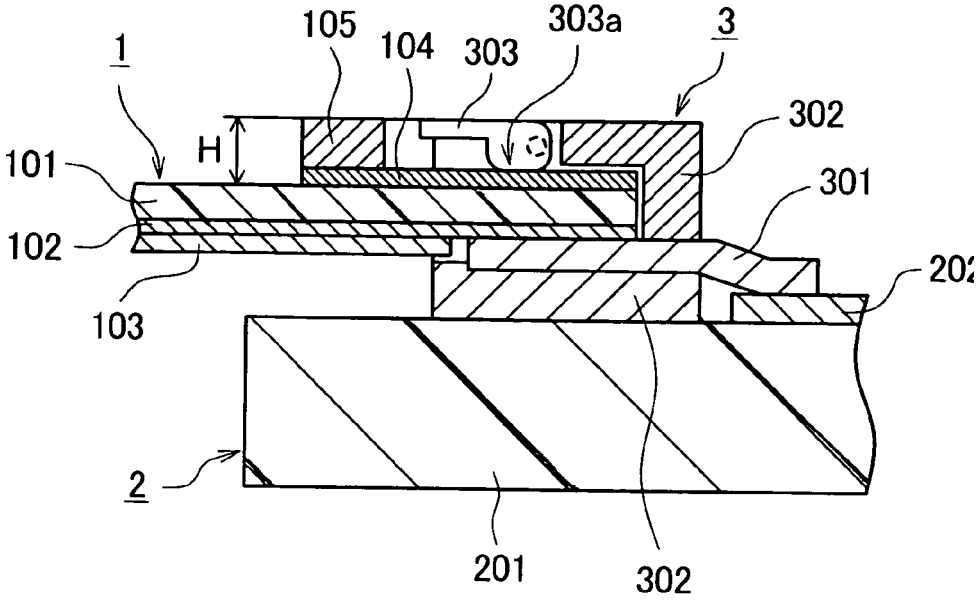
FIG. 5 is a schematic cross-sectional view for explaining a modification of the electronic device of the present invention.

FIG. 5 is a schematic cross-sectional view for explaining the modification of the electronic device of the present invention. Here, FIG. 5 is shows the same cross section as FIG. 2, that is, a cross-sectional view taken along a line A–A' in FIG. 1.

As in the case of the electronic device of the present invention, in providing the protective member 105 to the film-like wiring board 1, for example, as shown in FIG. 2, it may be possible to adopt the method which mounts the protective member 105 on the preset reinforcing member 104. However, in mounting the protective member 105 on the preset reinforcing member 104, for example, when other electronic part, other printed wiring board or a finger of an operator who performs an assembling operation comes into contact with the protective member 105, the protective member 105 may be peeled off. Accordingly, in mounting the protective member 105, it is preferable that the protective member 105 is integrally formed on the reinforcing member 104.

In integrally forming the protective member 105 on the reinforcing member 104, for example, as shown in FIG. 5, the reinforcing member 104 is not mounted on the film-like wiring board 1 but the protective member 105 is directly mounted on the insulating substrate 101. Here, on an interface of the protective member 105 with the insulating substrate 101, as shown in FIG. 5, a reinforcing portion 105*b* which extends to a region inserted into the connector 3 is provided. Here, in the example shown in FIG. 5, the reinforcing portion 105*b* corresponding to the reinforcing member 104 is mounted on the protective member 105. However, to the contrary, a protective portion corresponding to the protective member 105 may be mounted on the reinforcing member 104.

Embodiment

Figure 6:
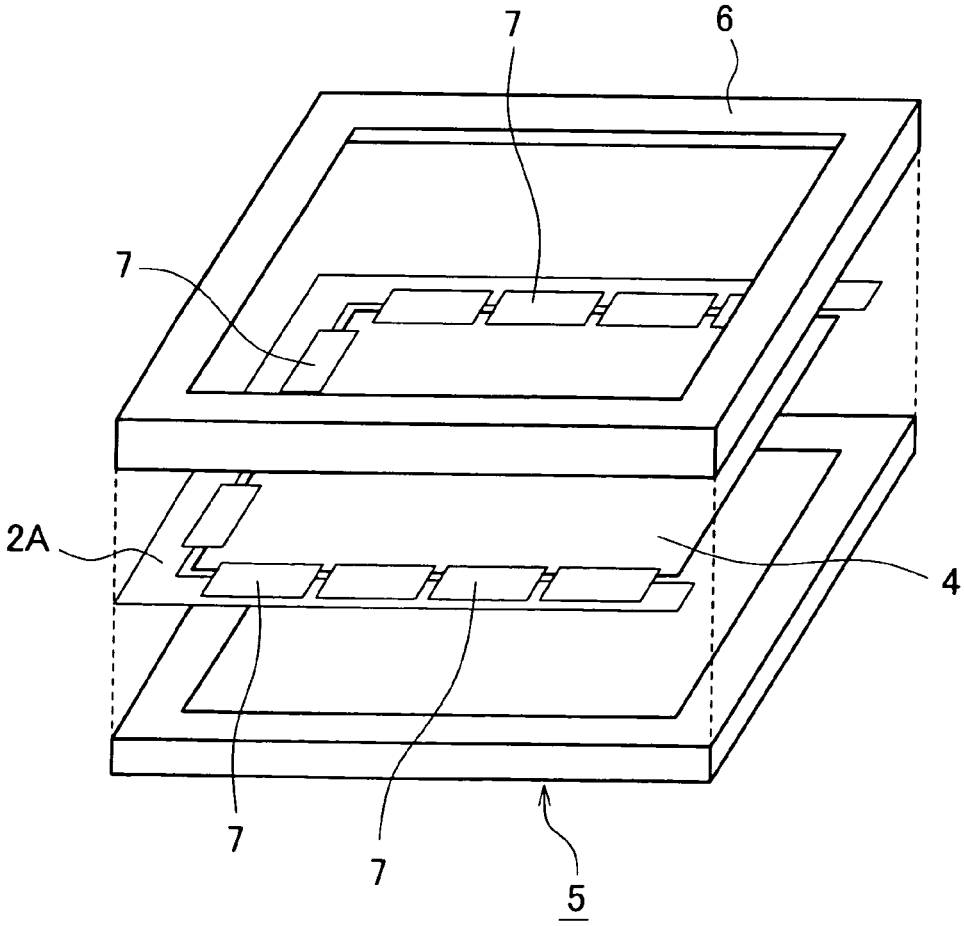
FIG. 6 is a schematic view showing the schematic constitution of a liquid crystal display device of one embodiment according to the present invention and also is an exploded perspective view showing a constitutional example of the liquid crystal display device.
Figure 7:
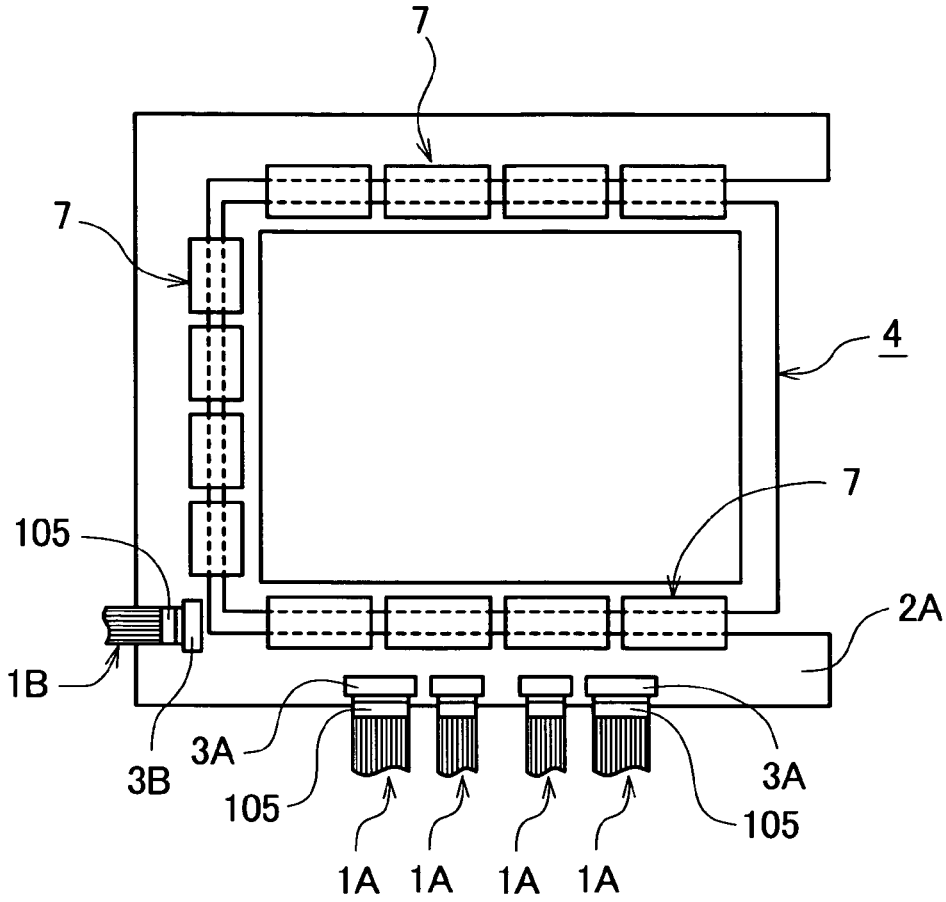
FIG. 7 is a schematic view showing the schematic constitution of a liquid crystal display device of one embodiment according to the present invention and also is a plan view for explaining an application example of the present invention.
Figure 8:
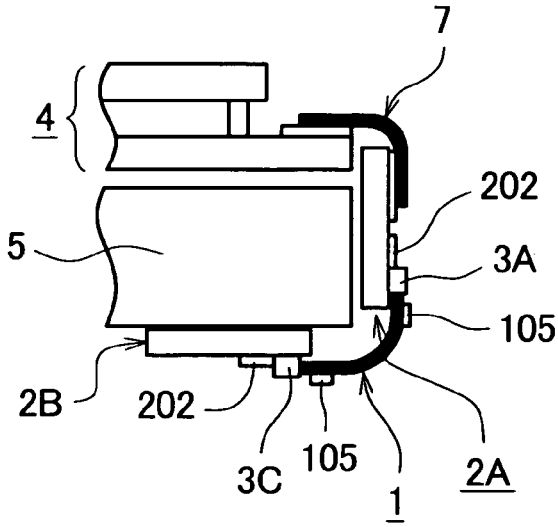
FIG. 8 is a schematic view showing the schematic constitution of a liquid crystal display device of one embodiment according to the present invention and also is a side view for explaining an application example of the present invention.
Figure 9:
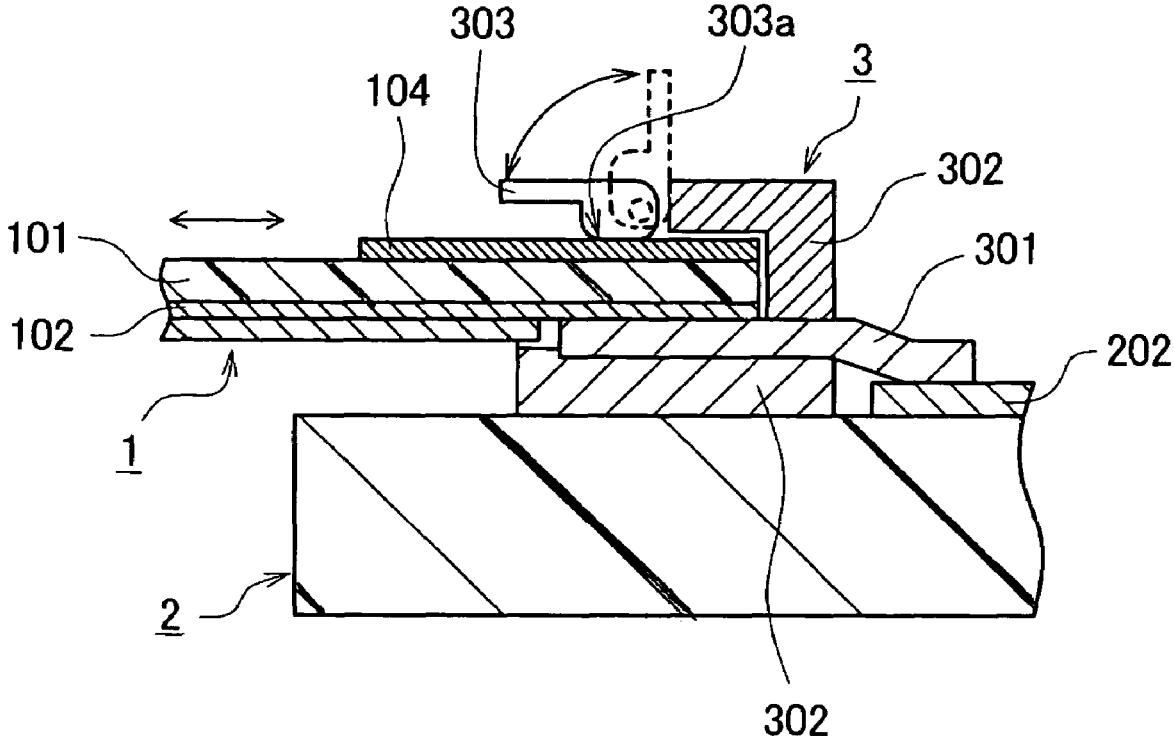
FIG. 9 is a schematic cross-sectional view for explaining a mounting method of a film-like wiring board which uses a conventional open/close-type locking connector.

FIG. 6 to FIG. 8 are schematic views showing the schematic constitution of the liquid crystal display device of one embodiment according to the present invention, wherein FIG. 6 is an exploded perspective view showing a constitutional example of the liquid crystal display device, FIG. 7 is a plan view for explaining an application example of the present invention, and FIG. 8 is a side view for explaining an application example of the present invention.

In FIG. 6 to FIG. 8, numerals 1A, 1B indicate film-like wiring boards 1, numerals 2A, 2B indicate printed wiring boards, numerals 3A, 3B, 3C indicate connectors, numeral 4 indicates a liquid crystal display panel, numeral 5 indicates a backlight unit, numeral 6 indicates a frame member, numeral 7 indicates a tape carrier package (TCP).

Further, as mentioned above, provided that the electronic device of the present invention includes the film-like wiring board 1, the printed wiring board 2 and the connector 3 having the constitution shown in FIG. 1 to FIG. 3, the other remaining constitution of the electronic device of the present invention may adopt any constitution. For example, as the electronic device to which the present invention is applicable, various electronic devices including a notebook-type PC, a PDA, a digital still camera, a mobile phone terminal, a liquid crystal display device and the like may be named. In this embodiment, as one application example, a constitutional example when the electronic device of the present invention is applied to the liquid crystal display device is explained.

The liquid crystal display device includes, for example, as shown in FIG. 6, a liquid crystal display panel 4, a backlight unit 5, a pair of polarizers (not shown in the drawing) which are arranged to sandwich the liquid crystal display panel 4, and a frame member 6 which integrally holds these parts.

Further, on an outer peripheral portion of the liquid crystal display panel 4, as shown in FIG. 6 and FIG. 7, the printed wiring board 2A is mounted, while lines (not shown in the drawing) of the printed wiring board 2A and lines (not shown in the drawing) of the liquid crystal display panel 4 are electrically connected with each other by the tape carrier package 7 on which a liquid-crystal-driving driver IC is mounted, for example.

Here, it is sufficient that the constitutions of the liquid crystal display panel 4, the backlight unit 5, the polarizers, the frame member, the tape carrier package 7 and the like have the same constitution as the corresponding parts used in the conventional liquid crystal display device and hence, the detailed explanation of these parts is omitted.

In the liquid crystal display device, to the printed wiring board 2A which is formed on a periphery of the liquid crystal display panel 4, for example, as shown in FIG. 7, a connector 3A which connects the film-like wiring board 1A for transmitting electric signals which are supplied to drain lines of the liquid crystal display panel 4 and a connector 3B which connects film-like wiring board 1B for transmitting electric signals which are supplied to gate lines of the liquid crystal display panel 4 are provided. Further, although not shown in FIG. 7, the respective film-like wiring boards 1A, 1B are, for example, connected with connectors which are mounted on a separate printed wiring board (timing controller) which is mounted on a back side of the backlight unit 5.

Here, the printed wiring board 2A may be, for example, as shown in FIG. 8, folded on the backlight unit 5 side by making use of the resiliency of the tape carrier package 7. Also in this case, for example, as shown in FIG. 8, one end of the film-like wiring board 1A which is connected to the connector 3A which is mounted on the printed wiring board 2A is connected to the connector 3C which is provided to the printed wiring board (timing controller) 2B which is mounted on the back surface of the backlight unit 5.

In assembling such a liquid crystal display device, for example, when an operation which mounts a cover (not shown in the drawing) for covering the printed wiring board 2B or an operation which integrally supports the printed wiring board 2A, the liquid crystal display panel 4, and the backlight unit 5 on the frame member 6 is performed, there may be a case that the cover or the frame member 6 is brought into contact with the locking members 303 of the connectors 3A, 3B, 3C and hence, the locking member 303 is shifted from a locking state to an open state. Further, in assembling the liquid crystal display device and performing an operation inspection thereafter, since the connectors 3A, 3B, 3C are covered with the cover and the frame member 6, it is impossible to confirm whether the locking member 303 is in a locking state or not. Accordingly, for example, when an operation defect attributed to the fact that the locking member 303 assumes an open state occurs, it is necessary to disassemble the assembled liquid crystal display device, to shift the locking member 303 which is in the open state to the locking state and, thereafter, to reassemble the liquid crystal display device and to perform an operation inspection of the liquid crystal display device.

Accordingly, the present invention is applied to the liquid crystal display device, for example, as shown in FIG. 7 and FIG. 8, wherein by providing the protective member 105 to the film-like wiring boards 1A, 1B, for example, it is possible to prevent the fact that when the operation which mounts the cover (not shown in the drawing) for covering the printed wiring board 2B or the operation which integrally supports and fixes the printed wiring board 2A, the liquid crystal display panel 4, and the backlight unit 5 on the frame member 6 is performed, the cover or the frame member 6 is brought into contact with the locking members 303 of the connectors 3A, 3B, 3C thus shifting the locking member 303 from the locking state to the open state. Accordingly, it is possible to reduce the operational defect attributed to the fact that the locking member 303 assumes the open state and, at the same time, it is no more necessary to perform the disassembling operation and the reassembling operation. As a result, it is possible to enhance the operability of the assembling operation of the liquid crystal display device.

As has been explained above, according to the liquid crystal display device of this embodiment, by connecting the film-like wiring boards 1A, 1B to the connectors 3A, 3B, 3C which are mounted on the printed wiring boards 2A, 2B, it is possible to prevent the locking member 303 from being shifted to the open state attributed to an unintended cause after the locking member 303 assumes the locking state whereby the operability of the assembling operation of the liquid crystal display device is enhanced.

Further, due to the provision of the protective member 105 to the film-like wiring boards 1A, 1B, by watching the positional relationship between the protective member 105 and the periphery thereof in inserting the film-like wiring boards 1A, 1B into the connector 3, it is possible to confirm whether the film-like wiring boards 1A, 1B are correctly inserted or not. Accordingly, the connection defect of the lines 102 of the film-like wiring board 1 and the leads 301 attributed to the insertion defect of the film-like wiring boards 1A, 1B can be reduced and the operability is enhanced.

Further, although the liquid crystal display device is exemplified as one example of the electronic device to which the present invention is applied in this embodiment, the electronic device is not limited to the liquid crystal display device and the present invention is applicable to any display device provided that the display device includes the film-like wiring board 1, the printed wiring board 2 and the connector 3 having the constitutions shown in FIG. 1 to FIG. 3.

The present invention has been explained specifically in conjunction with the embodiments heretofore. However, it is needles to say that the present invention is not limited to the above-mentioned embodiments and various modifications can be made without departing from the gist of the present invention.

For example, in this embodiment, the liquid crystal display device is exemplified. However, the present invention is applicable to any electronic device provided that the electronic device includes the film-like wiring board 1, the printed wiring board 2 and the connector 3 having the constitution shown in FIG. 1 to FIG. 3. As the electronic device to which the present invention is applied, besides the liquid crystal display device, various electronic devices such as a notebook-type PC, a PDA, a digital still camera, a mobile telephone terminal are named, for example.

What is claimed is:

1. An electronic device comprising:

a film-like wiring board which has a first lines layer and an insulating layer;

a printed wiring board which forms second lines which are connected with first lines of the first lines layer; and a connector which is formed on the printed wiring board and into which the film-like wiring board is inserted;

wherein the connector has a locking member which fixes the film-like wiring board to the connector;

wherein the film-like wiring board includes a projecting portion on the insulating layer; and wherein the locking member is positioned so as to be exposed from a portion of the connector and is formed between the projecting portion of the film-like wiring board which is exposed and the portion of the connector when the film-like wiring board is inserted into the connector.

2. An electronic device according to claim 1, wherein the projecting portion functions as a protective member.

3. An electronic device according to claim 1, wherein the projecting portion projects from a position at which the locking member is locked.

4. An electronic device comprising:

a film-like wiring board which forms first lines on a surface of a film-like insulating substrate; and a printed wiring board which forms second lines which are connected with the first lines thereon;

a connector which is formed on the printed wiring board and into which the film-like wiring board is inserted, the connector including leads which are electrically connected with the second lines, a support member which supports the leads and the film-like wiring board and a locking member which is arranged on a back side of the film-like wiring board opposite to a contact surface of the film-like wiring board with the first lines and the leads and is made to rotate about a predetermined shaft so as to bring the first lines and the leads into a contact and fixed state or to release the contact and fixed state, wherein the film-like wiring board includes a protective member which prevents the locking member from being shifted from the state in which the locking member brings the first lines and the leads into the contact and fixed state to a state in which the contact and fixed state is released on a surface side of a film-like insulating substrate which is brought into contact with the locking member.

5. An electronic device according to claim 4, wherein the film-like wiring board is arranged on a surface side of the film-like insulating substrate which is brought into contact with the locking member, a reinforcing member is arranged on a region which is inserted into the connector and an outside of the region, and the protective member is arranged on the reinforcing member.

6. An electronic device according to claim 4, wherein the protective member includes a reinforcing portion which extends in the direction toward the region which is inserted into the connector on an interface side thereof with the film-like insulating substrate.

7. An electronic device according to any one of claims 4 to 6, wherein a distance between a surface of the film-like insulating substrate and a point of the protective member remotest from a surface of the insulating substrate is equal to or more than a distance between the surface of the insulating substrate and a point of the locking member remotest from the surface of the insulating substrate in a state that the first lines and the leads are brought into a contact and fixed state.

8. A display device comprising:

a display panel;

a film-like wiring board which forms first lines on a surface of a film-like insulating substrate;

a printed wiring board which forms second lines which are electrically connected with the first lines thereon, and a connector which is formed on the printed wiring board and into which the film-like wiring board is inserted, the connector including leads which are electrically connected with the second lines, a support member which supports the leads and the film-like wiring board and a locking member which is arranged on a back side of the film-like wiring board opposite to a contact surface of the film-like wiring board with the first lines and the leads and is made to rotate about a predetermined shaft so as to bring the first lines and the leads into a contact and fixed state or to release the contact and fixed state, wherein the film-like wiring board includes a protective member which prevents the locking member from being shifted from the state in which the locking member brings the first lines and the leads into the contact and fixed state to a state in which the contact and fixed state is released on a surface side of a film-like insulating substrate which is brought into contact with the locking member.

9. A display device according to claim 8, wherein the film-like wiring board is arranged on a surface side of the film-like insulating substrate which is brought into contact with the locking member, a reinforcing member is arranged on a region which is inserted into the connector and an outside of the region, and the protective member is arranged on the reinforcing member.

10. A display device according to claim 8, wherein the protective member include a reinforcing portion which extends in the direction toward the region which is inserted into the connector on an interface side thereof with the film-like insulating substrate.

11. A display device according to any one of claims 8 to 10, wherein a distance between a surface of the film-like insulating substrate and a point of the protective member remotest from a surface of the insulating substrate is equal to or more than a distance between the surface of the insulating substrate and a point of the locking member remotest from the surface of the insulating substrate in a state that the first lines and the leads are brought into a contact and fixed state.

* * * * *